US009339825B2

(12) United States Patent
Koklu

(10) Patent No.: US 9,339,825 B2
(45) Date of Patent: May 17, 2016

(54) FLUIDIC OSCILLATOR HAVING DECOUPLED FREQUENCY AND AMPLITUDE CONTROL

(71) Applicant: The United States of America as represented by the Administrator of the National Aeronautics and Space Administration, Washington, DC (US)

(72) Inventor: Mehti Koklu, Hampton, VA (US)

(73) Assignee: The United States of America as represented by the Administrator of the National Aeronautics and Space Administration, Washington, DC (US)

( * ) Notice: Subject to any disclaimer, the term of this patent is extended or adjusted under 35 U.S.C. 154(b) by 176 days.

(21) Appl. No.: 13/786,608

(22) Filed: Mar. 6, 2013

(65) Prior Publication Data

US 2015/0238982 A1 Aug. 27, 2015

(51) Int. Cl.
*B05B 1/08* (2006.01)
*F15C 1/22* (2006.01)

(52) U.S. Cl.
CPC .... *B05B 1/08* (2013.01); *F15C 1/22* (2013.01)

(58) Field of Classification Search
CPC ..... B05B 1/08; F15C 1/22
USPC ..... 239/589.1, 555, 11
See application file for complete search history.

(56) References Cited

U.S. PATENT DOCUMENTS 4,508,267 A 4/1985 Stouffer
4,596,364 A * 6/1986 Bauer ..... A46B 11/00 137/842
4,955,547 A * 9/1990 Woods ..... 239/589.1
5,860,603 A * 1/1999 Raghu et al. ..... 239/589.1
6,948,244 B1 * 9/2005 Crockett ..... 29/890.142
7,293,722 B1 * 11/2007 Srinath et al. ..... 239/589.1
2012/0037731 A1 * 2/2012 Cheng et al. ..... 239/589.1

FOREIGN PATENT DOCUMENTS

EP 2554854 A2 2/2013

OTHER PUBLICATIONS

Gad-El-Hak, M., "Flow Control," Applied Mechanics Reviews, Oct. 1989, pp. 261-293, vol. 42, No. 10.

Greenblatt, D. and Wygnanski, I. J., "The control of flow separation by periodic excitation," Progress in Aerospace Sciences, 2000, pp. 487-545, vol. 36, Issue 7.

Magill, J. C. and McManus, K. R., "Exploring the Feasibility of Pulsed Jet Separation Control for Aircraft Configurations," Journal of Aircraft, Jan.-Feb. 2001, pp. 48-56, vol. 38, No. 1.

(Continued)

*Primary Examiner* — Arthur O Hall
*Assistant Examiner* — Juan C Barrera
(74) *Attorney, Agent, or Firm* — Robin W. Edwards

(57) ABSTRACT

A fluidic oscillator having independent frequency and amplitude control includes a fluidic-oscillator main flow channel having a main flow inlet, a main flow outlet, and first and second control ports disposed at opposing sides thereof. A fluidic-oscillator controller has an inlet and outlet. A volume defined by the main flow channel is greater than the volume defined by the controller. A flow diverter coupled to the outlet of the controller defines a first fluid flow path from the controller's outlet to the first control port and defines a second fluid flow path from the controller's outlet to the second control port.

10 Claims, 4 Drawing Sheets

(56) References Cited

OTHER PUBLICATIONS

Roth, J. R., Sherman, D. M., and Wilkinson, S. P., "Electrohydrodynamic Flow Control with a Glow-Discharge Surface Plasma," AIAA Journal, Jul. 2000, pp. 1166-1172, vol. 38, No. 7.
Enloe, C. L., McLaughlin, T. E., Vandyken, R. D., Kachner, K. D., Jumper, E. J., Corke, T. C., Post. M., and Haddad, O., "Mechanisms and Responses of a Single Dielectric Barrier Plasma Actuator: Geometric Effects," AIAA Journal, Mar. 2004, pp. 595-604, vol. 42, No. 3.
Glezer, A. and Amitay, M., "Synthetic Jets," Annual Review of Fluid Mechanics, 2002, pp. 503-529, vol. 34.
Viets, H., "Flip-Flop Jet Nozzle," AIAA Journal, Oct. 1975, pp. 1375-1379, vol. 13, No. 10.
Beale, R. B. and Lawler, M. T., "Development of a Wall-Attachment Fluidic Oscillator Applied to Volume Flow Metering," 1997, pp. 989-996, vol. 1, Issue Pt. 2.
Wang, H., Beck, S. B. M., Priestman, G. H., and Boucher, R. F., "Fluidic Pressure Pulse Transmitting Flowmeter," Chemical Engineering Research & Design, Transactions of the Institute of Chemical Engineers, May 1997, pp. 381-391, vol. 75, No. A4.
Desalvo, M., Whalen, E., and Glezer, A., "High-Lift Enhancement using Fluidic Actuation," 48th AIAA Aerospace Sciences Meeting, Orlando, FL; AIAA 2010-863; Jan. 4-7, 2010, pp. 1-17.
Seele, R., Tewes, P., Woszidlo, R., McVeigh, M. A., Lucas, N. J., and Wygnanski, I. J., "Discrete Sweeping Jets as Tools for Improving the Performance of the V-22," Journal of Aircraft, Nov.-Dec. 2009, pp. 2098-2106, vol. 46, No. 6.
Phillips, E., Woszidlo, R., and Wygnanski, I., "The Dynamics of Separation Control on a Rapidly Actuated Flap", AIAA 2010-4246, AIAA 5th Flow Control Conference, Chicago, Illinois, Jun. 28-Jul. 1, 2010, pp. 1-16.
Cerretelli C., Wuerz, W., and Gharaibah, E., "Unsteady Separation Control on Wind Turbine Blades Using Fluidic Oscillators," AIAA Journal, Jul. 2010, pp. 1302-1311, vol. 48, No. 7.
Gregory, J. W., Gnanamanickam, E. P., Sullivan, J. P., and Raghu, S., "Variable-Frequency Fluidic Oscillator Driven by Piezoelectric Bender," AIAA Journal, Nov. 2009, pp. 2717-2725, vol. 47, No. 11.
Tesar, V., "The Guided Jet Principle," Fluidics Quarterly, vol. 3, No. 4, 1971, pp. 77-99.
Taft, C. K., and Herrick, B. M., "A Proportional Piezoelectric Electro-Pneumatic Servovalve Design," Proceedings of the Joint Automotive Control Conference, The American Automatic Control Council, Charlottesville, Virginia, Jun. 17-19, 1981, Paper No. WA-8A.
Chen, R., and Lucas, G. G., "An Investigation into the Use of Piezo-Fluidic Combined Units as Fuel Injectors for Natural Gas Engines," International Fall Fuels & Lubricants Meeting & Exposition, Oct. 14-17, 1996, pp. 131-142, vol. 1208, Society of Automotive Engineers, Inc.
Chen, R., "Piezo-fluidic Gaseous Fuel MPI System for Natural Gas Fuelled IC Engines," JSME International Journal, Series B (Fluids and Thermal Engineering), 2001, pp. 158-165, vol. 44, No. 1.
Gregory, J. W., Ruotolo, J. C., Byerley, A. R., and McLaughlin, T. E., "Switching Behavior of a Plasma-Fluidic Actuator," 45th AIAA Aerospace Sciences Meeting and Exhibit, AIAA Paper 2007-0785, Reno, NV, Jan. 8-11, 2007, pp. 1-11.
Gokoglu, S. A., Kuczmarski, M. A., Culley, D. E., and Raghu, S., "Numerical Studies of a Fluidic Diverter for Flow Control," AIAA-2009-4012, 39th AIAA Fluid Dynamics Conference, San Antonio, TX, Jun. 22-25, 2009, pp. 1-14.
Culley, D. E., "Variable Frequency Diverter Actuation for Flow Control," 3rd AIAA Flow Control Conference, AIAA Paper 2006-3034, San Francisco, California, Jun. 5-8, 2008, pp. 1-12.
Gokoglu, S. A., Kuczmarski, M. A., Culley D. E., and Raghu, S., "Numerical Studies of an Array of Fluidic Diverter Actuators for Flow Control," 41st AIAA Fluid Dynamics Conference and Exhibit, AIAA 2011-3100, Honolulu, Hawaii, Jun. 27-30, 2011, pp. 1-11.
Gokoglu, S. A., Kuczmarski, M. A., Culley, D. E., and Raghu, S., "Numerical Studies of a Fluidic Diverter for Flow Control," NASA/TM-2009-216088, Dec. 2009.
Taft, C. K., and Herrick, B. M., "A Proportional Piezoelectric Electro-Pneumatic Valve Deaign," Journal of Dynamic Systems, Measurement and Control, vol. 103, No. 4, 1981, pp. 361-365.

* cited by examiner

FLUIDIC OSCILLATOR HAVING DECOUPLED FREQUENCY AND AMPLITUDE CONTROL

STATEMENT REGARDING FEDERALLY SPONSORED RESEARCH OR DEVELOPMENT

The invention was made by an employee of the United States Government and may be manufactured and used by or for the Government of the United States of America for governmental purposes without the payment of any royalties thereon or therefor.

CROSS-REFERENCE TO RELATED PATENT APPLICATION

This application is related to co-pending U.S. patent application Ser. No. 13/786,713, titled "Fluidic Oscillator Array for Synchronized Oscillating Jet Generation," filed on the same day as this application.

BACKGROUND OF THE INVENTION

1. Field of the Invention

This invention relates to fluidic oscillators. More specifically, the invention is a fluidic oscillator having frequency control features that allow the oscillator's frequency to be controlled independently of the oscillator's mass flow rate or amplitude.

2. Description of the Related Art

In the 1900s, fluidic oscillators were developed for use as logical function operators. More recently, fluidic oscillators have been proposed for use as active flow control devices where an oscillator's jet output is used to control a fluid flow (e.g., gas or liquid). FIGS. 1A-1C schematically illustrate the basic operating principles of a fluidic oscillator. Briefly, fluid flow 100 enters a fluidic oscillator 10 at its input 10A and attaches to either sidewall 12 or 14 (e.g., right sidewall 14 in the illustrated example) due to the Coanda effect as shown in FIG. 1A. A backflow 102 develops in a right hand side feedback loop 18. Backflow 102 causes fluid flow 100 to detach from right sidewall 14 (FIG. 1B) and attach to left sidewall 12 (FIG. 1C). When fluid flow 100 attaches to left sidewall 12, a backflow 104 develops in left hand side feedback loop 16 which will force fluid flow 100 to switch back to its initial state shown in FIG. 1A. As a result of this activity, fluid flow 100 oscillates/sweeps back and forth at the output 10B of oscillator 10.

For conventional fluidic oscillators, the frequency of the oscillations is directly dependent on the supply pressure and hence mass flow rate (or amplitude) of the oscillator. However, for practical applications, it is highly desirable to decouple the frequency and amplitude of the oscillator so that the frequency of the oscillator could be controlled independently of its amplitude. A frequency-decoupled fluidic oscillator could thus deliver desired mass flow rates without changing the frequency or could deliver desired frequency oscillations at desired mass flow rates.

BRIEF SUMMARY OF THE INVENTION

Accordingly, it is an object of the present invention to provide a fluidic oscillator having frequency control features.

Another object of the present invention is to provide a fluidic oscillator whose frequency is independent of the oscillator's mass flow rate or amplitude.

Still another object of the present invention is to provide a method of decoupling frequency control from amplitude control in a fluidic oscillator.

Other objects and advantages of the present invention will become more obvious hereinafter in the specification and drawings.

In accordance with the present invention, a fluidic oscillator having independent frequency and amplitude control includes a fluidic-oscillator main flow channel having a main flow inlet and a main flow outlet. The main flow channel has a first control port and a second control port disposed at opposing sides thereof. The main flow channel defines a first volume between the main flow inlet and the main flow outlet. A fluidic-oscillator controller has an inlet and outlet with a second volume being defined between its inlet and outlet. The first volume defined by the main flow channel is greater than the second volume defined by the controller. A flow diverter coupled to the outlet of the controller defines a first fluid flow path from the outlet to the first control port and defines a second fluid flow path from the outlet to the second control port.

DETAILED DESCRIPTION OF THE INVENTION

Figures 1A, 1B, 1C:
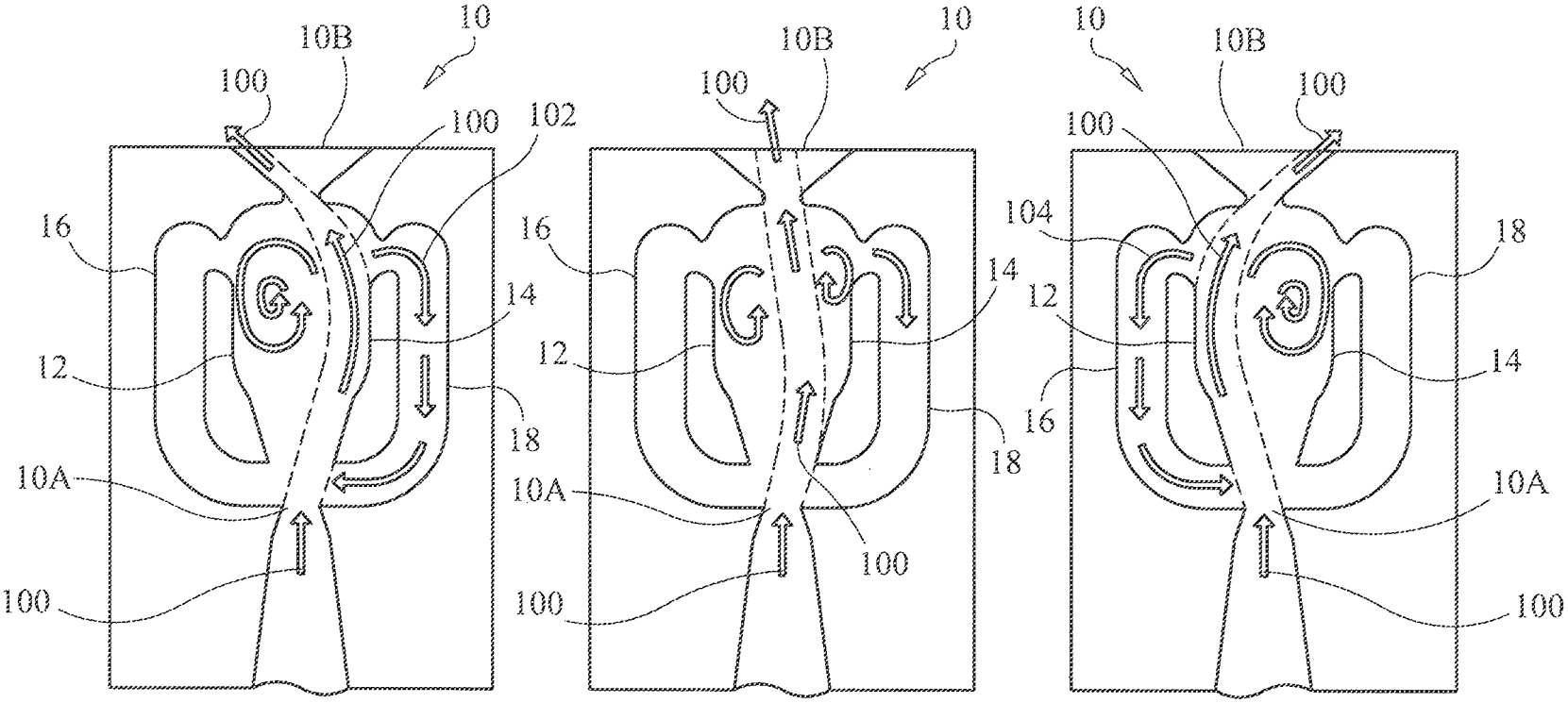
FIG. 1A PRIOR ART
FIG. 1B PRIOR ART
FIG. 1C PRIOR ART
FIGS. 1A-1C schematically illustrate the operating principles of a fluidic oscillator in accordance with the prior art.
Figure 2:
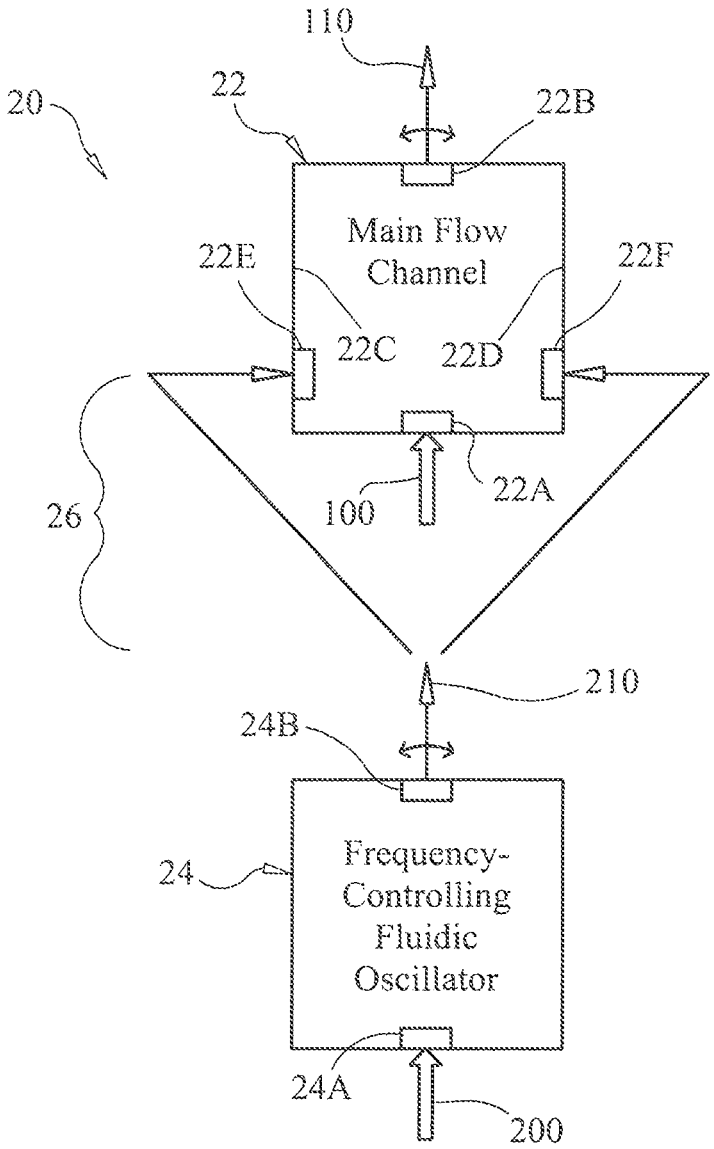
FIG. 2 is a schematic illustration of a fluidic oscillator having independent frequency and amplitude control in accordance with an embodiment of the present invention.

Referring again to the drawings and more specifically to FIG. 2, a fluidic oscillator for generating an oscillating jet whose frequency is controlled independently of the jet's mass flow rate (or amplitude) in accordance with an embodiment of the present invention is illustrated schematically and is referenced generally by numeral 20. Fluidic oscillator 20 includes a main oscillating-flow channel 22, a frequency-controlling fluidic oscillator 24 (or fluidic-oscillator controller as it will also be referred to herein), and a fluid flow diverter 26 fluidically coupling frequency-controlling fluidic oscillator 24 to main flow channel 22.

Main oscillating-flow channel 22 is configured as the main flow channel of a conventional fluidic oscillator, but does not have conventional feedback loops coupled thereto. That is, channel 22 only has an inlet 22A for receiving a (main or amplitude-controlling) fluid flow 100, an outlet 22B through which the fluid flow will exit as an oscillating jet 110, opposing Coanda surfaces 22C/22D, and opposing-side control ports 22E/22F. The particular shape/configuration of inlet 22A, outlet 22B, Coanda surfaces 22C/22D, and ports 22E/22F are not limitations of the present invention. The volume $V_{22}$ of main oscillating-flow channel 22 (i.e., between inlet 22A and outlet 22B) is known.

Frequency-controlling fluidic oscillator 24 is configured as a conventional fluidic oscillator having an inlet 24A for receiving a (frequency controlling) fluid flow 200 and an outlet 24B through which the fluid flow will exit as an oscillating jet 210. Fluidic oscillator 24 will also include conventional feedback loops terminating in feedback and control ports (not shown) used in the creation of oscillating jet 210 as would be understood in the art. The volume $V_{24}$ of fluidic oscillator 24 is known and should be smaller than the volume $V_{22}$ of main oscillating-flow channel 22. For reasons that will be explained further below, the smaller volume of fluidic oscillator 24 ensures that the mass flow rate (amplitude) of fluidic oscillator 24 is less than that of main oscillating-flow channel 22.

Fluid flow diverter 26 is a fluid-flow splitting device used to direct oscillating jet 210 in an alternating fashion to control ports 22E and 22F of main oscillating-flow channel 22. The frequency of oscillating jet 210 serves as the frequency control for main oscillating-flow channel 22 producing oscillating jet 110. Since frequency-controlling fluidic oscillator 24 only needs to disturb the flow moving through channel 22 (i.e., analogous to disruptions provided by feedback loops in conventional fluidic oscillators), a relatively small mass flow through oscillator 24 is all that is required. In general, the smaller mass flow for frequency control is achieved when the volume $V_{22}$ is at least twice as large as the volume $V_{24}$. However, it is to be understood that the volume differential between main oscillating-flow channel 22 and fluidic oscillator 24 can be tailored for a specific application without departing from the scope of the present invention.

Figure 3:
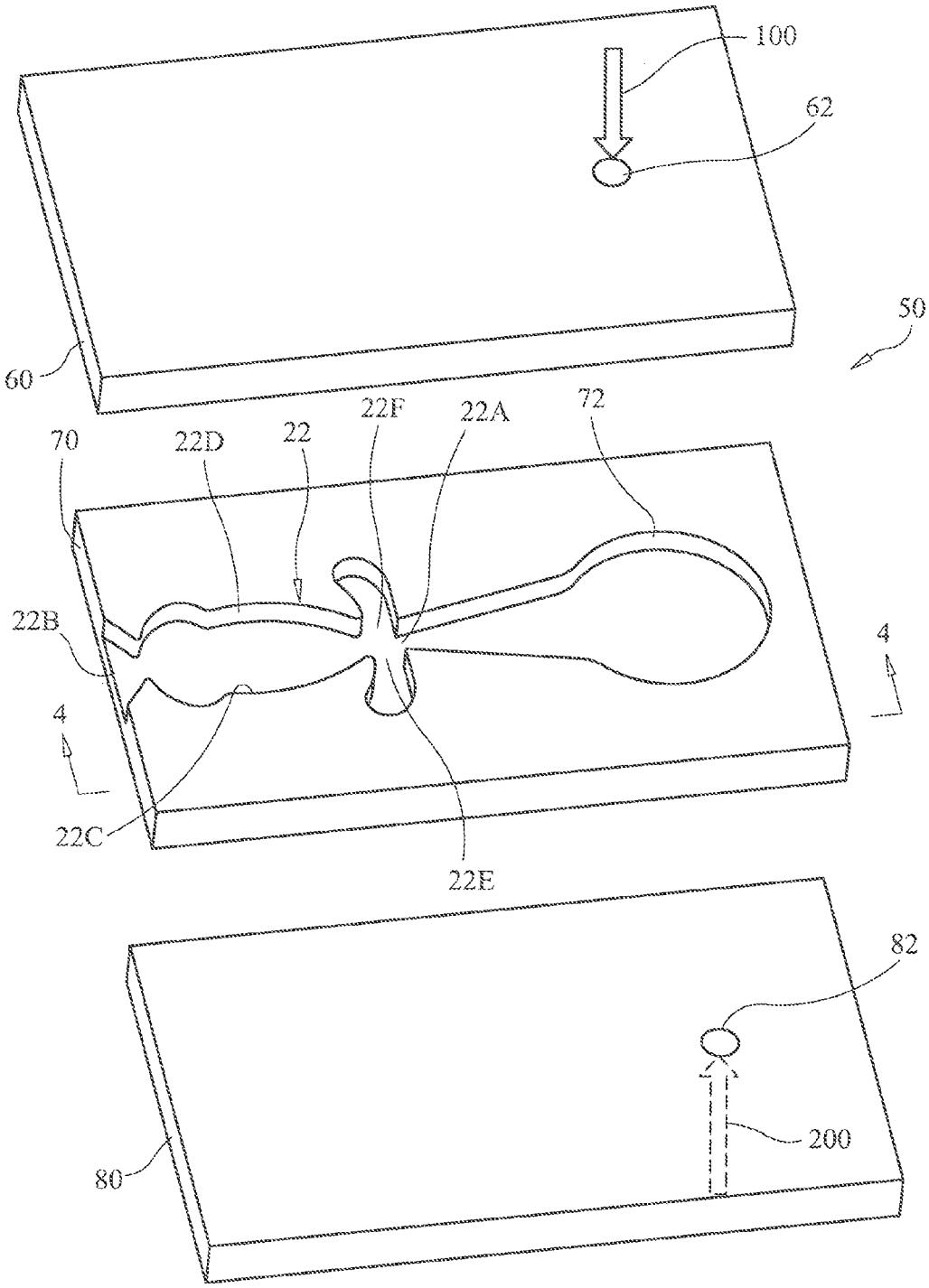
FIG. 3 is an exploded perspective view of a multi-layer fluidic oscillator having independent frequency and amplitude control in accordance with an embodiment of the present invention.
Figure 4:
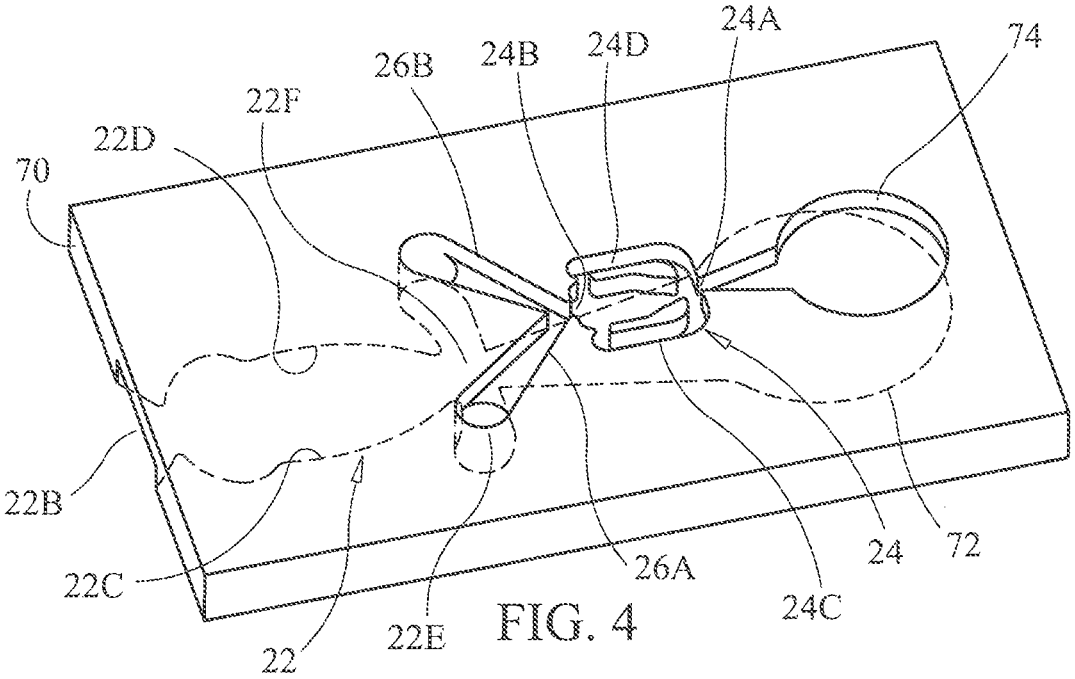
FIG. 4 is an isolated perspective view of the fluidic-oscillator controller portion of the present invention.
Figure 5:
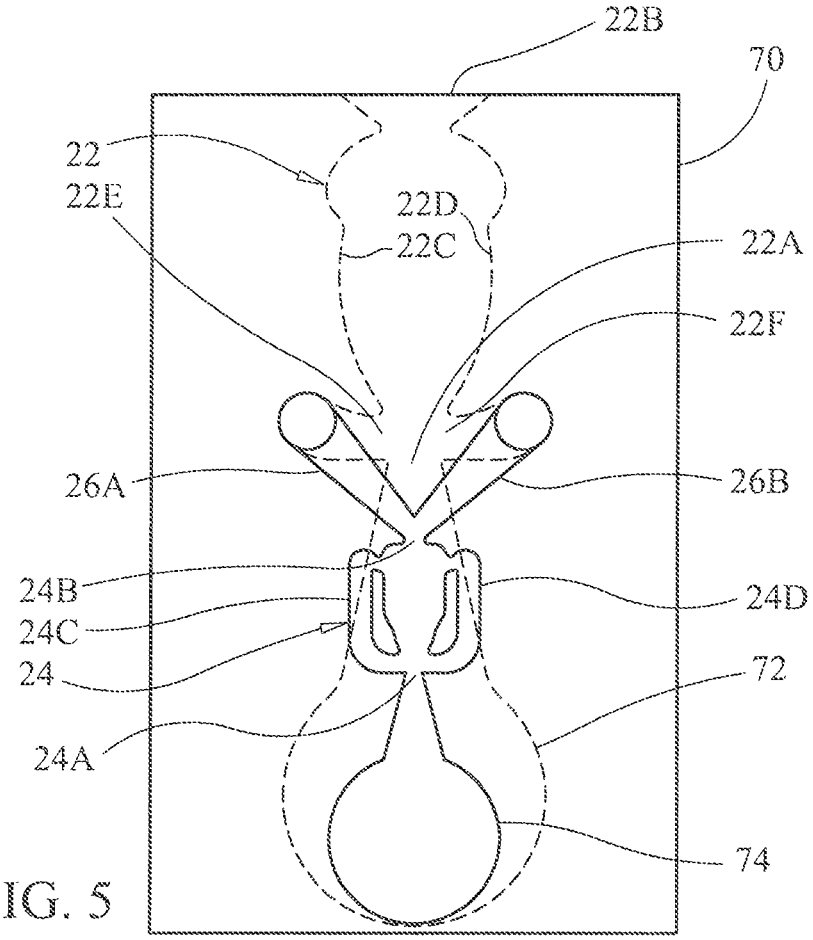
FIG. 5 is a plan view of the fluidic-oscillator controller portion of the present invention.

A variety of approaches can be used to construct a frequency-controlled fluidic oscillator 24 in accordance with the present invention. By way of example, a layered-construction fluidic oscillator 50 will be explained herein with simultaneous reference to FIGS. 3-5 where common reference numerals are used in the various views. Fluidic oscillator 50 is constructed from three layers/panels 60, 70, and 80, where panels 60 and 80 sandwich panel 70. Panels 60 and 80 are essentially covers for oscillator 50 with each of panels 60 and 80 having a respective fluid-flow inlet hole 62 and 82 formed therethrough.

In general, panel 70 has the main oscillating-flow channel's shape/volume formed on one face thereof and the frequency-controlling fluidic oscillator's shape/volume formed on the opposing face thereof. When panels 60 and 80 sandwich panel 70, the main oscillating-flow channel and frequency-controlling fluidic oscillator of oscillator 50 are formed. The present invention's fluid flow diverter is formed in panel 70. More specifically, one face of panel 70 defines a plenum region 72 that receives incoming fluid flow 100 (i.e., the main or amplitude-controlling fluid flow) via inlet hole 62. Main oscillating-flow channel 22 has its inlet 22A in fluid communication with plenum region 72. Control ports 22E/22F are disposed on either side of main oscillating-flow channel 22. As mentioned above, the particular shape/configuration of main oscillating-flow channel 22 is not a limitation of the present invention. The opposing face of panel 70 defines a plenum region 74 (visible in FIGS. 4 and 5) that receives incoming fluid flow 200 (i.e., the frequency controlling fluid flow) via inlet hole 82. Frequency-controlling fluidic oscillator 24 has its inlet 24A in fluid communication with plenum region 74. As would be understood in the art, fluidic oscillator 24 defines conventional feedback loops 24C and 24D.

Diverter 26 is in fluid communication with outlet 24B of frequency-controlling fluidic oscillator 24 and control ports 22C/22D of main oscillating-flow channel 22. More specifically, a first flow path 26A formed in and through panel 70 is directed from outlet 24B to control port 22E, while a second flow path 26B formed in and through panel 70 is directed from outlet 24B to control port 22F. In this way, the frequency-controlling oscillating jet 210 is supplied to control ports 22E/22F in an alternating fashion in accordance with the frequency of oscillating jet 210.

The advantages of the present invention are numerous. Frequency control of the fluidic oscillator's main oscillating-flow channel is decoupled from its amplitude. In this way, a desired mass flow rate (i.e., through the main oscillating-flow channel) can be delivered without changing the frequency thereof, or the frequency can be changed while maintaining a particular mass flow rate (i.e., through the main oscillating-flow channel). The approach is simple and requires no moving parts.

Although the invention has been described relative to specific embodiments thereof, there are numerous variations and modifications that will be readily apparent to those skilled in the art in light of the above teachings. It is therefore to be understood that, within the scope of the appended claims, the invention may be practiced other than as specifically described.

What is claimed as new and desired to be secured by Letters Patent of the United States is:

1. A fluidic oscillator having independent frequency and amplitude control comprising:

a fluidic-oscillator main flow channel having a main flow inlet configured to receive an amplitude controlling fluid flow and a main flow outlet, said main flow channel having a first control port and a second control port disposed at opposing sides thereof, said main flow channel defining a first volume between said main flow inlet and said main flow outlet;

a fluidic-oscillator controller having an inlet configured to receive a frequency controlling fluid flow and an outlet, wherein a second volume is defined between said inlet and said outlet, and wherein said first volume is greater than said second volume; and a flow diverter coupled to said outlet of said controller, said first control port, and said second control port, said flow diverter defining a first fluid flow path directed from said outlet only to said first control port and defining a second fluid flow path directed from said outlet only to said second control port, wherein said amplitude controlling fluid flow controls an amplitude of a fluid flow through said main flow channel and said frequency controlling fluid flow controls a frequency of said fluid flow through said main flow channel, and wherein said amplitude controlling fluid flow is independent of said frequency controlling fluid flow.

2. A fluidic oscillator as in claim 1, further comprising a first plenum in fluid communication with said main flow inlet and a second plenum in fluid communication with said inlet of said controller.

3. A fluidic oscillator as in claim 2, wherein said main flow channel and said first plenum are formed using a first panel and a second panel, wherein said controller and said second plenum are formed using said second panel and a third panel, and wherein said flow diverter is formed using said second panel.

4. A fluidic oscillator as in claim 1, wherein said first volume is at least two times greater than said second volume.

5. A fluidic oscillator as in claim 1, wherein said main flow channel, said flow diverter, and said controller are formed using a layered construction.

6. A fluidic oscillator having independent frequency and amplitude control, comprising:

a fluidic-oscillator main flow channel having only a main flow inlet configured to receive an amplitude controlling fluid flow, a main flow outlet, a first control port, and a second control port, wherein said first control port and said second control ports are disposed at opposing sides of said main flow channel, said main flow channel defining a first volume between said main flow inlet and said main flow outlet;

a fluidic-oscillator controller having an inlet configured to receive a frequency controlling fluid flow and an outlet, wherein a second volume is defined between said inlet and said outlet, and wherein said first volume is greater than said second volume;

and a flow diverter coupled to said outlet of said controller, said first control port, and said second control, said flow diverter defining a first fluid flow path directed from said outlet only to said first control port and defining a second fluid flow path directed from said outlet only to said second control port, wherein said amplitude controlling fluid flow controls an amplitude of a fluid flow through said main flow channel and said frequency controlling fluid flow controls a frequency of said fluid flow through said main flow channel, and wherein said amplitude controlling fluid flow is independent of said frequency controlling fluid flow.

7. A fluidic oscillator as in claim 6, further comprising a first plenum in fluid communication with said main flow inlet and a second plenum in fluid communication with said inlet of said controller.

8. A fluidic oscillator as in claim 7, wherein said main flow channel and said first plenum are formed using a first panel and a second panel, wherein said controller and said second plenum are formed using said second panel and a third panel, and wherein said flow diverter is formed using said second panel.

9. A fluidic oscillator as in claim 6, wherein said first volume is at least two times greater than said second volume.

10. A fluidic oscillator as in claim 6, wherein said main flow channel, said flow diverter, and said controller are formed using a layered construction.

* * * * *